United States Patent [19]

Suzuki

[11] 4,080,803

[45] Mar. 28, 1978

[54] JEWELRY ARTICLE WITH SELECTIVELY VISIBLE PORTIONS

[76] Inventor: Fukutaro Suzuki, 3-28-8, Arakawa, Arakawa-ku, Tokyo, Japan

[21] Appl. No.: 706,565

[22] Filed: Jul. 19, 1976

[51] Int. Cl.[2] ..... A44C 9/00

[52] U.S. Cl. ..... 63/15.4; 63/31

[58] Field of Search ..... 63/31, 15.4, 20

[56] References Cited

U.S. PATENT DOCUMENTS

| | | | |
|---|---|---|---|
| 1,178,186 | 4/1916 | Spaney | 63/15.4 |
| 1,245,201 | 11/1917 | Depollier | 63/15.4 |
| 1,246,670 | 11/1917 | Spaney | 63/20 |
| 1,716,640 | 6/1929 | Kaufer et al. | 63/20 |
| 2,117,176 | 5/1938 | Keehnel et al. | 63/15.4 |

FOREIGN PATENT DOCUMENTS

| | | | |
|---|---|---|---|
| 418,033 | 2/1967 | Switzerland | 63/31 |

*Primary Examiner*—F. Barry Shay
*Attorney, Agent, or Firm*—Michael J. Striker

[57] ABSTRACT

A multipurpose ring arrangement has a decorative body including two decorative sections mounted on one another for pivoting between an open and a closed position and lockable in the latter position, the decorative sections together bounding an aperture opening at an exposed surface, and a depression opening on a hidden surface facing oppositely to the exposed surface of the decorative body. Two gem-carrying elements each having a different gem are mounted on one of the decorative sections each for pivoting between a retracted position in which the respective gem-carrying element is received in the depression, and an extended position in which the respective gem-carrying element is received in the aperture and the gem thereof is visible at the exposed surface of the decorative body. An additional gem-carrying element has a form of a discrete, independently usable, ring having a setting portion in which still another gem is set and which may be received in the aperture instead of the two first-mentioned gem-carrying elements which are then both received in the depression of the decorative body. Thus, each of the rings can be used independently of the other, but such rings can also be combined with one another.

10 Claims, 8 Drawing Figures

JEWELRY ARTICLE WITH SELECTIVELY VISIBLE PORTIONS

BACKGROUND OF THE INVENTION

The present invention relates to a multipurpose article of jewelry, and more particularly to a multipurpose decorative ring.

Decorative articles, such as articles of jewelry, and especially decorative rings, have been known and used since probably the very dawn of mankind. Such rings are worn for different reasons, by they symbolic to indicate, for instance, marital status or the like, possessive, to show, for instance, the wealth of the wearer, or emotional to show, for instance, the mood or feeling of the wearer. So, for instance, rings of different shape or carrying different gems will be carried by users of different ages, different rings will be worn for different occasions, and rings of different values will be worn by people of different social status. Whatever the reasons for changing the rings may be in the case of a particular user, it has been heretofore customary for persons of substantial and even not so substantial means to have a multitude of rings some of which were worn for some occasions and others for other occasions, and some of which were used by the same person at her or his young age and others as that person has been advancing in years.

It will be appreciated that the purchase of a complete set of rings which are suited for all contingencies which the owner of such set may encounter during his or her lifetime is a rather expensive proposition. Therefore, more often than not, the owner may not own the ring suited for some particular occasion, be it a happy event, such as a marriage or graduation, or a sad event, such as a funeral. Also, as the owner advances in years, some of the rings which were perfectly suited in his or her younger years, are obsolete or unsuited for use when the owner attains his or her middle age, and so on. For these reasons, except for very wealthy individuals, it was heretofore a very rare situation when an owner was able to assemble a complete set of rings for such different occasions.

In view of the above-mentioned need for, but expensiveness of, the assembling of a full set of different rings for different occasions, it has been heretofore customary, instead of obtaining such a full set of high-quality rings, to obtain either an incomplete set of high-quality rings, in which event it may be difficult to find a ring to suit a particular occasion, or to obtain a complete set of rings for various occasions, in which event, however, a person of modest means had to resort to the purchase of inferior quality rings set with inferior-quality gems or even simulated gems. Either of these situations, of course, is less than desirable.

SUMMARY OF THE INVENTION

Accordingly, it is a general object of the present invention to avoid the disadvantages of the prior art.

More particularly, it is an object of the present invention to devise an article of jewelry, particularly a ring, which is not possessed of the disadvantages of the prior-art articles of jewelry.

Still another object of the present invention is to provide a ring which can be used for different occasions and by wearers of different ages.

It is a concomitant object of the present invention to provide a ring which is very versatile and rather inexpensive nevertheless.

Yet another object of the present invention is to provide a ring having high-quality gems for the price of, or not considerably above, the heretofore necessary set of different rings with inferior quality gems.

It is a still further object of the present invention to provide a ring which can be easily modified for use at different events.

In pursuance of these objects and others which will become apparent hereafter, one feature of the present invention resides, in a multipurpose article of jewelry, briefly stated, in a combination which comprises a decorative body having an exposed surface and an aperture which opens on the exposed surface, a plurality of gem-carrying elements having various gems, and means for so connecting the gem-carrying elements to the decorative body that at least one gem carried by a selective gem-carrying element is interchangeably accommodated in the aperture of the decorative body to be visible at the exposed surface thereof. According to an additional currently preferred feature of the present invention, the decorative body has a hidden surface which faces oppositely to the exposed surface, and a depression which communicates with the aperture and opens on the hidden surface. In this case, the above-mentioned connecting means may include at least one pivot which mounts at least one of the gem-carrying elements on the decorative body for pivoting between an extended position in which the gem of the one gem-carrying element is accommodated in the aperture of the decorative body, and a retracted position in which the one gem-carrying element is received in the above-mentioned depression. Advantageously, the connecting means includes an additional pivot which is offset from the above-mentioned one pivot and which mounts an additional gem-carrying element on the decorative body for pivoting between the above-mentioned extended and retracted positions in a manner similar to the pivoting of the above-mentioned one gem-carrying element.

Preferably, the decorative body may include two decorative sections, and means for displaceably connecting the decorative sections to one another, the decorative sections bounding the above-mentioned aperture and the above-mentioned depression with one another. Under these circumstances, the above-mentioned one pivot may be mounted on one, and the additional pivot on the other, of the decorative sections. The displaceably connecting means may include a hinge which is designed to pivotably connect the decorative sections to one another, and a lock which is mounted on one of the decorative sections and releasably engages a recess on the other decorative section.

According to a further aspect of the present invention, the connecting means may include connecting surfaces which at least partially surround the above-mentioned aperture and which engage the selected gem-carrying element accommodated in the aperture.

The multipurpose article of jewelry may further comprise means for supporting the decorative body on the wearer, and one of the gem-carrying elements may have a setting portion in which a respective gem is set, and a mounting portion which is adapted to be juxtaposed with the supporting means of the decorative body to form a part of the above-mentioned connecting means. Preferably, both the supporting means of the decorative body and the mounting portion of the one gem-carrying element are ring-shaped and are adapted to embrace a finger of the wearer. Thus, the one gem-carrying element is configurated so as to constitute a complete ring which can be used, such as for a daily use, independently of the decorative body and the above-mentioned ring-shaped supporting means thereof. On the other hand, the decorative body and the ring-shaped supporting means thereof may be so configurated as to constitute a complete ring that can be used independently of the above-mentioned one gem-carrying element.

The above-discussed multipurpose article of jewelry has many advantages. First of all, such an article of jewelry will have an excellent decorative value. Because of the multitude of combinations which may be obtained when the multipurpose ring of the present invention is purchased, the overall purchase price of the article of jewelry according to the present invention will be much lower than if a separate ring was purchased similar to each of such combinations.

A further advantage obtained by the decorative body according to the present invention is that it may incorporate at least two different gems in such a manner that each of the gems can be accommodated in the aperture of their decorative body, depending on the use to which the ring is to be put.

Also, as already mentioned above, the gem-carrying element which is equipped with its own ring-shaped mounting portion can be used independently of the more elaborate ring which has the decorative body, and vice versa. Thus, these two rings can be used either separately or in combination with one another which increases their versatility.

It will be easily seen that when, for instance, the elaborate ring carries two of the gem-carrying elements in the depression thereof, and only one simple ring is available for combination with the elaborate ring, there exist four possibilities: either the simple ring is worn by itself, or the elaborate ring is worn with one of the gem-carrying elements pivoted thereon accommodated in the aperture, or with the other gem-carrying element pivoted thereon accommodated in the aperture, or with the setting portion of the simple ring accommodated in such aperture. Of course, the possibility of combination multiplies with increasing number of gem-carrying elements received in the depression of the decorative body, and with increasing number of single rings which may be combined with the elaborate ring.

It will be appreciated that a similar principle may also be used for other articles of jewelry, such as necklaces, pendants, bracelets and the like. Such additional articles of jewelry may be so configurated and modified as to be fittingly compatible with the above-discussed ring or combination of rings.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DISCUSSION OF THE PREFERRED EMBODIMENT

Figure 1:
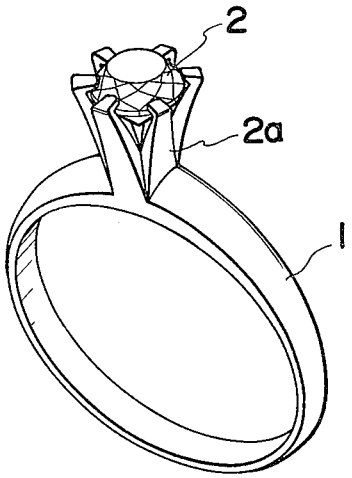
FIG. 1 is a perspective view of a simple ring according to the present invention.

Referring now to the drawing, and first to FIG. 1 thereof, it may be seen that a simple ring is illustrated thereon, such ring having a ring-shaped mounting portion 1, a setting portion 2*a*, and a gem 2 supported in the setting portion 2*a*. As already explained above, this ring includees all the ingredients of a decorative ring so that it may be worn by itself, particularly for less than festive occasions.

On the other hand, FIGS. 2 and 5 through 8 illustrate an elaborate ring which includes a ring-shaped support portion 4, and a decorative portion which is constituted by a pair of decorative sections designated by reference numerals 5 and 6. The decorative sections 5 and 6 bound with one another a central aperture 3 which is adapted to receive a gem-carrying or gem-setting element or portion therein. As illustrated in particular in FIG. 2, a pivot 7 mounts the decorative section 6 on the decorative section 5, the latter being directly connected to the ring-shaped support portion 4. One of the sections, such as the decorative section 6, is provided at its circumference with a plurality of recesses 8, and a locking arrangement 9 is mounted on the other section, in this instance 5, and is adapted to engage one of the recesses 8. The locking arrangement 9 is relatively small and also partially hidden underneath the decorative sections 5 and 6 so that it will be barely visible and hardly noticeable during the use of the ring.

Figure 4:
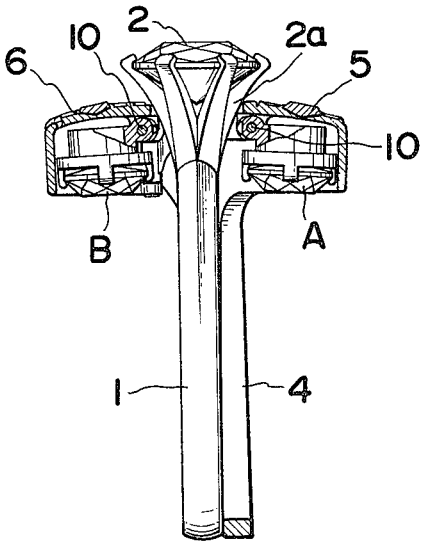
FIG. 4 is a central sectional view through the elaborate ring of the combination of FIG. 3.
Figure 7:
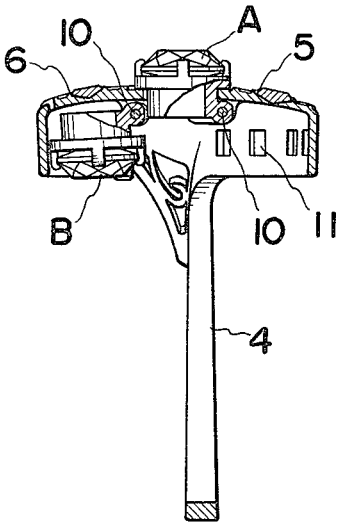
FIG. 7 is a central sectional view of the ring of FIG. 6.

As seen particularly in the cross-sectional views of FIGS. 4 and 7, respective pivots 10 are mounted on the sections 5 and 6, each of the pivots 10 supporting one gem-carrying element, designated by the reference characters A and B, respectively, in the depression which is provided in the respective decorative sections 5 and 6. In FIG. 4, both of the gem-carrying elements A and B are shown in their retracted positions, that is, both elements A and B are received in the above-mentioned depression.

Figure 2:
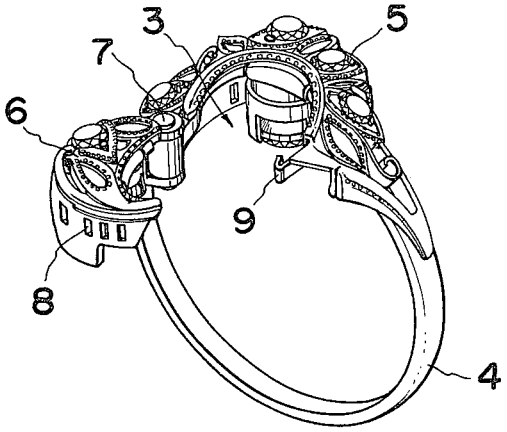
FIG. 2 is a perspective view of an elaborate ring according to the present invention having two gem-carrying elements having different gems pivotally supported in a depression of the decorative body, illustrated in an open position of the decorative sections which constitute the decorative body.
Figure 3:
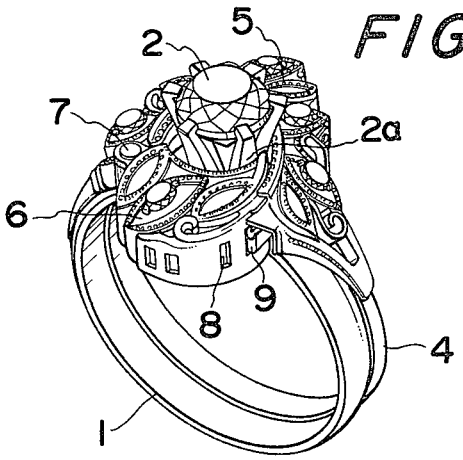
FIG. 3 is a perspective view of a combination of the rings of FIGS. 1 and 2, with the decorative sections in their closed position.

In the arrangement which is illustrated in FIGS. 3 and 4, the rings of FIGS. 1 and 2 are combined with one another. In other words, the mounting portion 1 of the simple ring is juxtaposed with the support portion 4 of the elaborate ring, and the setting portion of the simple ring is received in the aperture 3 of the elaborate ring. The surfaces of decorative sections 5 and 6 which surround aperture 3 engage setting portion 2a and serve to connect the rings. Under these circumstances, the gem-carrying elements A and B and the gems set therein are invisible during the use of such a combined ring.

Figure 5:
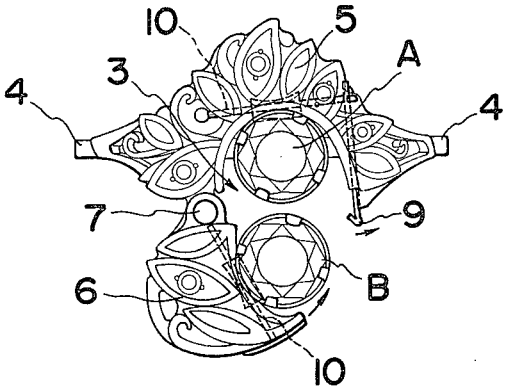
FIG. 5 is a top plan view on the exposed surface of the decorative body, with the decorative sections thereof being in their open position, and with both of the pivotally mounted gem-carrying elements in their extended positions.

As seen in particular in FIG. 5, each of the gem-carrying elements A and B can be rotated about its pivot 10 into an extended position in which the gem carried by the respective carrying element A or B is visible at the exposed surface of the decorative body 5 and 6. Of course, during the actual use, only one of the gem-carrying elements A or B, if any, will be in its extended position, while the other will be in its retracted position and accommodated in the depression formed in the decorative body 5 and 6.

Figure 6:
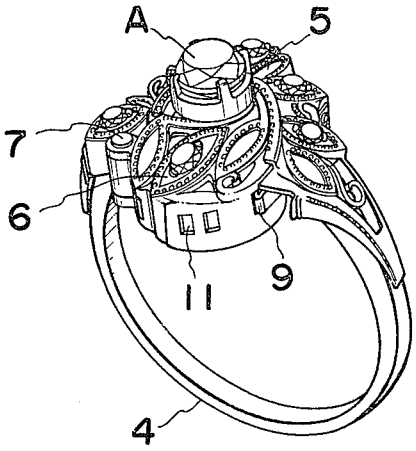
FIG. 6 is a perspective view of the elaborate ring of FIG. 2 with one of the pivotally connected gem-carrying elements being received in the aperture bounded by the decorative sections of the decorative body which are in their closed position.
Figure 8:
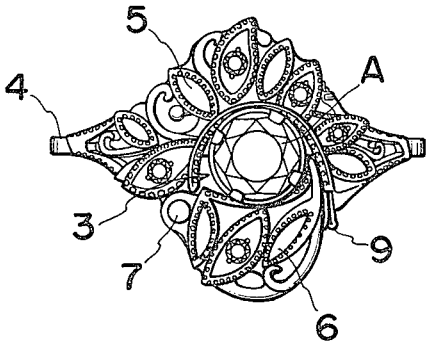
FIG. 8 is a top plan view on the exposed surface of the decorative body of FIG. 6.

This particular situation is clearly illustrated in FIGS. 6 through 8 in which the gem-carrying element A is in its extended position, that is, it is accommodated in the opening 3 of the elaborate ring, while the gem-carrying element B is in its retracted position, that is, received in the depression bounded by the decorative body 5 and 6. FIG. 7 shows how surfaces of decorative body 5, 6 surround aperture 3 and maintain element A in extended position. It will be appreciated that, upon opening the sections 5 and 6, the gem-carrying element A can be moved from its extended into its retracted position, and the gem-carrying element B can be moved from its retracted to its extended position, if so desired. Thus, any of the gems of the gem-carrying elements A and B can be made visible at the exposed surface of the decorative body 5, 6.

In addition to the recess 8, the circumferential wall of either one or both of the decorative sections 5 and 6 may be provided with a plurality of cutouts or openings 11 which, however, serve only decorative or ornamental purposes. The locking arrangement 9, which may be resiliently yieldable so as to properly engage the appropriate recess 8, cooperates only with such recess 8 and not with any of the recesses or cutouts 11.

It will be appreciated from the above discussion that the ring of the present invention, which incorporates two separate rings which can be used either separately or in combination with one another, is adapted for use in different combinations for different occasions. So, the ring of FIG. 1 can be used by itself for simple occasions, while the ring of FIG. 2, either alone or in combination with the ring of FIG. 1, may be used for more festive occasions.

It will be understood that each of the elements described above, or two or more together, may also find a useful application in other types of constructions differing from the types described above. So, for instance, a similar concept can also be used in different articles of jewelry, such as bracelets, necklaces or pendants, among others, which may then be of a fitting configuration and appearance to the above-discussed ring.

While the invention has been illustrated and described as embodied in a multipurpose article of jewelry, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A multipurpose article of jewelry comprising, in combination, a decorative body having an exposed surface, a hidden surface facing oppositely to said exposed surface, an aperture which opens on said exposed surface, and a depression which communicates with said aperture and opens on said hidden surface; a plurality of gem-carrying elements having various gems; and means for so connecting at least two of said gem-carrying elements to said decorative body that at least one gem carried by a selected one of said gem-carrying elements is interchangeably accommodated in said aperture of said decorative body to be visible at said exposed surface thereof, including at least two pivots offset from one another and each mounting a respective one of said gem-carrying elements on said decorative body for pivoting between an extended position in which said gem of said respective gem-carrying element is accommodated in said aperture, and a retracted position in which said respective gem-carrying element is received in said depression.

2. A combination as defined in claim 1, wherein said decorative body includes two decorative sections, and means for displaceably connecting said decorative sections to one another; wherein said decorative sections bound said aperture and said depression with one another; and wherein said one pivot is mounted on one, and said additional pivot on the other, of said decorative sections.

3. A combination as defined in claim 2, wherein said displaceably connecting means includes a hinge pivotably connecting said decorative sections to one another, and a lock mounted on one of said decorative sections and releasably engaging a recess on the other decorative section.

4. A combination as defined in claim 1, wherein said connecting means includes connecting surfaces at least partially surrounding said aperture and engaging said selected gem-carrying element accommodated in said aperture.

5. A multipurpose article of jewelry comprising, in combination, a decorative body having an exposed surface, a hidden surface facing oppositely to said exposed surface, an aperture which opens on said exposed surface, and a depression which communicates with said aperture and opens on said hidden surface; a plurality of gem-carrying elements which have various gems at least one of said elements being separate from said decorative body; and means for so connecting at least said one and another of said gem-carrying elements to said decorative body that at least one gem carried by a selected one of said gem-carrying elements is interchangeably accommodated in said aperture of said decorative body to be visible at said exposed surface thereof, including a setting portion of said one gem-carrying element, connecting surfaces of said decorative body which at least partially surround said aperture and engage said setting portion of said one gem-carrying element when the latter is accommodated in said aperture and occupies a predetermined space thereat, and at least one pivot mounting said other of said gem-carrying elements on said decorative body for pivoting between an extended position in which said gem of said other gem-carrying element is accommodated in said aperture, and a retracted position in which said other gem-carrying element is received within said depression and without said space.

6. A combination as defined in claim 5; wherein said connecting means includes an additional pivot offset from said one pivot and mounting an additional other of said gem-carrying elements on said decorative body for pivoting between said extended and retracted positions similarly to the pivoting of said other gem-carrying element.

7. A combination as defined in claim 5; and further comprising means for supporting said decorative body on the wearer; and wherein said respective gem-carrying element has a mounting portion adapted to be juxtaposed with said supporting means to form a part of said connecting means.

8. A combination as defined in claim 7, wherein both said supporting means and said mounting portion are ring-shaped and adapted to embrace a finger of the wearer.

9. A combination as defined in claim 8, wherein said one gem-carrying element is so configurated as to constitute a complete ring which can be used independently of said decorative body and said ring-shaped supporting means thereof.

10. A combination as defined in claim 8, wherein said decorative body and said ring-shaped supporting means thereof are so configurated as to constitute a complete ring which can be used independently of said one gem-carrying element.

* * * * *